United States Patent [19]

Iwakura et al.

[11] 4,370,067

[45] Jan. 25, 1983

[54] ELECTRONIC TIMEPIECE WITH GAIN/LOSS ADJUSTMENT

[75] Inventors: Ryoji Iwakura; Tatsuo Nitta; Kazutoshi Takahashi, all of Tokorozawa, Japan

[73] Assignee: Citizen Watch Company Limited, Tokyo, Japan

[21] Appl. No.: 147,006

[22] Filed: May 6, 1980

Related U.S. Application Data

[63] Continuation-in-part of Ser. No. 913,917, Jun. 7, 1978, abandoned.

[30] Foreign Application Priority Data

Apr. 11, 1978 [JP] Japan ..... 53/42383

[51] Int. Cl.[3] ..... G04B 17/20; G04C 17/00; G04B 23/02

[52] U.S. Cl. ..... 368/202; 368/239; 368/245

[58] Field of Search ..... 368/72, 73, 85–87, 368/155, 156, 184–188, 200–202, 250, 251

[56] References Cited

U.S. PATENT DOCUMENTS

| | | | |
|---|---|---|---|
| 3,895,486 | 7/1975 | Hammer et al. | 368/202 |
| 3,938,316 | 2/1976 | Morokawa et al. | 368/201 |
| 3,999,370 | 12/1976 | Morokawa et al. | 368/202 |
| 4,015,208 | 3/1977 | Hammer et al. | 368/202 |
| 4,114,363 | 9/1978 | Mamura | 368/187 |
| 4,143,362 | 3/1979 | Ulmer | 340/347 M |
| 4,272,840 | 6/1981 | Morozumi et al. | 368/202 |

*Primary Examiner*—Vit W. Miska

*Attorney, Agent, or Firm*—Jordan and Hamburg

[57] ABSTRACT

An electronic timepiece in which an operating state of a timepiece circuit is controlled by a control circuit composed of a counter responsive to clock pulses from the timepiece circuit, a digital/analog converter for converting a digital output signal from the counter to an analog output signal, a potentiometer adapted to generate an analog input signal, and a comparator for comparing the analog output signal and the analog input signal to generate an output signal which is applied to the counter to control the same by which a control signal is generated to control the operating state of the timepiece.

10 Claims, 16 Drawing Figures

ELECTRONIC TIMEPIECE WITH GAIN/LOSS ADJUSTMENT

This is a continuation in part of patent application Ser. No. 913,917 filed on June 7, 1978 and now abandoned.

BACKGROUND OF THE INVENTION

This invention relates to electronic timepieces and more particularly to an electronic timepiece whose operating state is adapted to be controlled by an analog factor.

In conventional electronic timepieces, the gain/loss adjustment is widely accomplished by controlling the value of a resistor or capacitor in an oscillator circuit, a method which is quite inconvenient since extreme care is necessary for fine adjustments. The effect of stray capacitance also makes it difficult to perform the gain/-loss adjustment, while resistance and capacitance is subject to change due to variations in the enviroment, a factor which gives rise to variations in the gain/loss and thus makes it difficult to assure timepiece accuracy.

It is, therefore, an object of the present invention to provide an electronic timepiece which improves upon these short-comings, especially a timepiece which is highly reliable, small in size and low in cost.

SUMMARY OF THE INVENTION

According to the present invention, the gain/loss adjustment is performed by electronically controlling the frequency of a standard signal in a timepiece. Instead of directly adjusting the parameters of an oscillator as was the case in the prior art, adjustment is accomplished indirectly through electronic control so that the effects of stray capacitance at the time of an adjustment are eliminated, thereby allowing an easier speed setting than was possible in the prior art. Moreover, integrated circuitry can be adapted for all circuit elements with the exception of the quartz crystal and potentiometer in the oscillator unit. In addition, as will later be described, a potentiometer in a control section for gain/loss adjustment is adapted to vary the ratio of a resistance-type voltage divider so as to control the voltage applied to the input of a comparator. It is therefore unnecessary to precisely set the resistance value, and problems due to temperature changes or edging do not arise. In the past, an adjustment by varying a trimming capacitor exploited a change in electrostatic capacitance, thereby making it difficult to maintain timepiece accuracy. However, the aforementioned defects can still be eliminated even by making use of a trimming capacitor, with the proviso that the capacitor is employed as an electrostatic potentiometer in the same way as the resistance-type potentiometer illustrated in the present invention.

DESCRIPTION OF THE PREFERRED EMBODIMENTS

Figure 1:
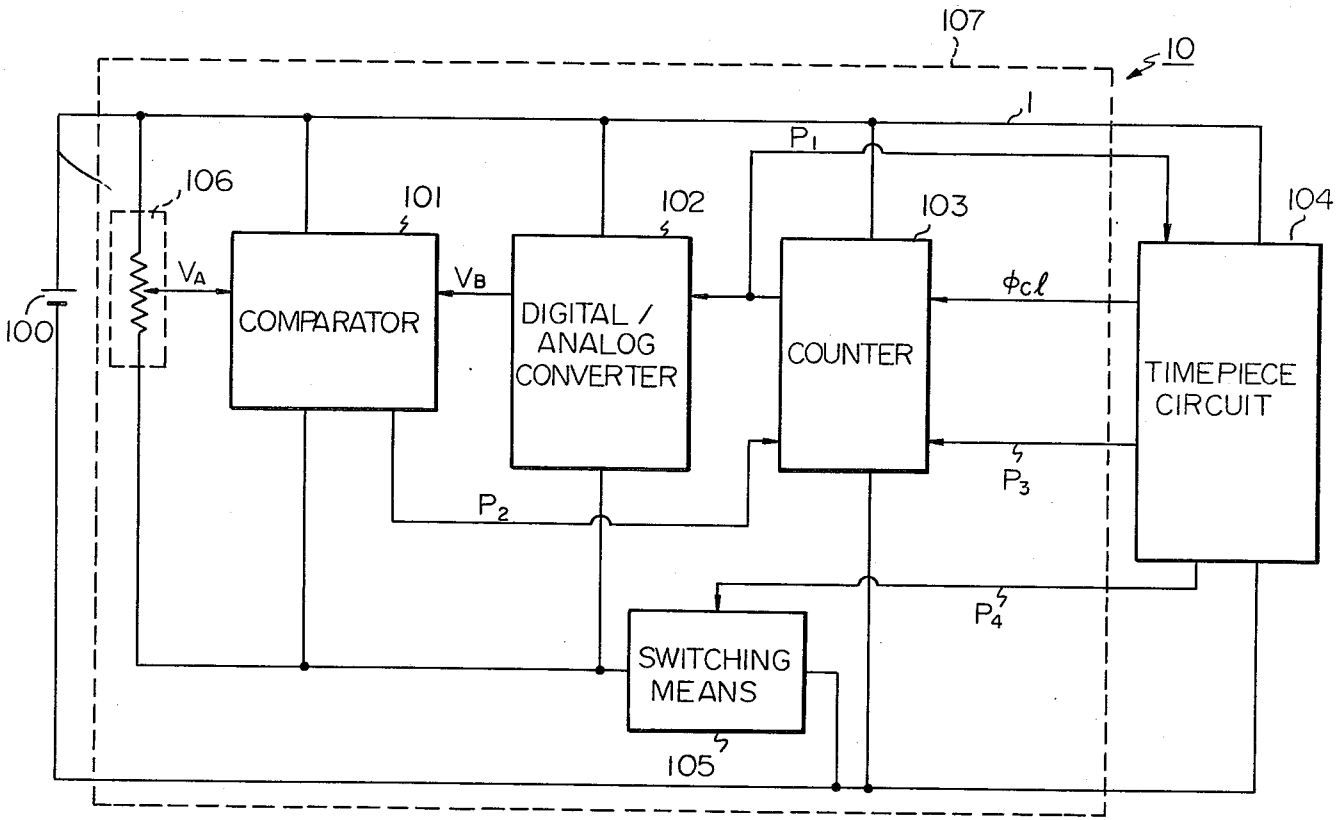
FIG. 1 is a system block diagram of an electronic timepiece according to the present invention.

FIG. 1 is a block wiring diagram of a preferred embodiment of an electronic timepiece according to the present invention. The bold lines indicate wiring for carrying electric power, and the fine lines indicate the flow of signals. The timepiece 10 comprises an electronic timepiece circuit 104 and a control circuit 107 adapted to control an operational state of the timepiece circuit 104. The control circuit 107 comprises a comparator 101 which, upon comparing two analog signals $V_A$, $V_B$ and determining whether or not they are in coincidence, produces an output $P_2$ which is either at a high (H) logic level or low (L) logic level depending upon the coincidence or non-coincidence of the analog signals. Block 102 is a digital/analog converter (hereafter referred to a D/A converter) adapted to convert a digital signal $P_1$ to an analog signal $V_B$. Block 103 is a counter operated by a clock pulse $\phi_{Cl}$ delivered from the timepiece circuit 104. Block 105 is a switch responsive to a signal $P_4$ to open or close the path which supplies energy to the D/A converter 102, the comparator 101 and a potentiometer 106, thereby energizing these components in selected time periods to reduce power consumption.

Signal $\phi_{Cl}$ is a clock pulse which renders counter 103 operative, and the output of counter 103 is the signal $P_1$. Signal $P_3$ is an intermittent signal that appears once every second or every 10 seconds, to drive control circuit 107 at this time instant to reduce the consumption of power required for driving the control circuit 107. Signal $P_2$ is produced by the comparator 101 which detects the absence or presence of a potential difference, and allows counter 103 to continue the count initiated by clock pulse $\phi_{Cl}$, or causes the counter to cease the counting operation.

The circuit depicted in FIG. 1 operates as follows. Initially, it will be assumed that switch 105 has been opened by signal $P_4$. Accordingly, potentiometer 106, comparator 101 and D/A converter 102 are in the non-operative state, and signal $P_2$ causes counter 103 to stop the count initiated by clock pulse $\phi_{Cl}$, at which time the output $P_1$ produced by counter 103 is fed to the timepiece circuit 104, whereby the gain/loss adjustment is performed in accordance with the signal $P_1$. Signal $P_4$ is automatically produced by timepiece circuit 104 or produced thereby when the crown is operated and thus closes switch 105, thereby activating potentiometer 106, comparator 101 and converter 102. At this time, signal $P_3$ resets counter 103 which then begins counting based on clock pulse $\phi_{Cl}$. It should be noted that counter 103 may be arranged so as to begin counting based on previous count in response to clock pulse $\phi_{Cl}$. Counter output $P_1$ is converted to analog signal $V_B$, and the counter continues counting by virtue of the clock pulses until comparator 101 detects coincidence between $V_B$ and $V_A$. Accordingly, once there is coincidence between $V_A$ and $V_B$, signal $P_1$ is fed as a control signal to block 104 where the operating state such as gain/loss is controlled independent of the control signal. This operation is repeated responsive to the intermittent signal $P_3$. When the degree of gain/loss adjustment is to be changed, $V_A$ is varied by changing the ratio of the divided resistance by means of potentiometer 106; hence, through the operation described above, signal $P_1$ which now depends on $V_A$ is fed to the timepiece circuit 104 where the control of the operating state is performed.

The operation of switch 105 is as follows. The system which employs the A/D converter inevitably increases power consumption when connected directly to the timepiece circuit. The main purpose of switch 105 is to eliminate this defect by making use of a timing pulse which is produced by the timepiece circuit. Signal $P_4$ which intermittently instructs the switch to close is obtained from the low frequency output of a frequency divider, from the output of a counter incorporated in the timepiece circuit, or from an independently constructed timer. If, for example, signal $P_4$ closes switch 105 for 10 msec once every hour, the power reduction ratio becomes 1/360,000. If the circuitry is constructed of C/MOS integrated circuits and the amount of current consumed during continuous operation is assumed to be 100 $\mu$A. The average current will become 3 PA by adopting intermittent operation. However, when adjusting or controlling the operating state of the timepiece circuit, the period of this intermittent operation for sampling is too long so that the effect of the adjustment cannot be fed back in a rapid manner. It is possible to eliminate this defect by establishing a relationship between the operation of the crown and the sampling period. In other words, the effect of an adjustment can be rapidly obtained as an input signal by allowing the sampling operation to take place every 5 seconds with the crown in the pulled-out state, or by allowing the sampling operation to take place continuously by pulling out the crown. It is also possible to arrange that a single intermittent operation of potentiometer 106, comparator 101 and digital-to-analog converter 103 is initiated by the action of pulling out the crown, i.e. by actuating switch 105 once each time the crown is pulled out. This will ensure minimum power consumption. Continuous operation is permissible if, in designing the C/MOS IC, a differential amplifier and resistance elements are designed with a high impedence for operation in a low current region. In such case, switch 105 can be considered to be normally closed, and it is therefore unnecessary to use the switch. While the circuits shown by blocks in FIG. 1 may be composed of bipolar transistors, the circuits may preferably composed of field effect transistors in order to reduce the power consumption. If, further, the circuits are composed of complementary pairs of field effect transistors, smaller power consumption can be obtained. Also, MIS type, conjunction-type and static dielectric type field effect transistors may be used for the circuits mentioned above.

Figure 2:
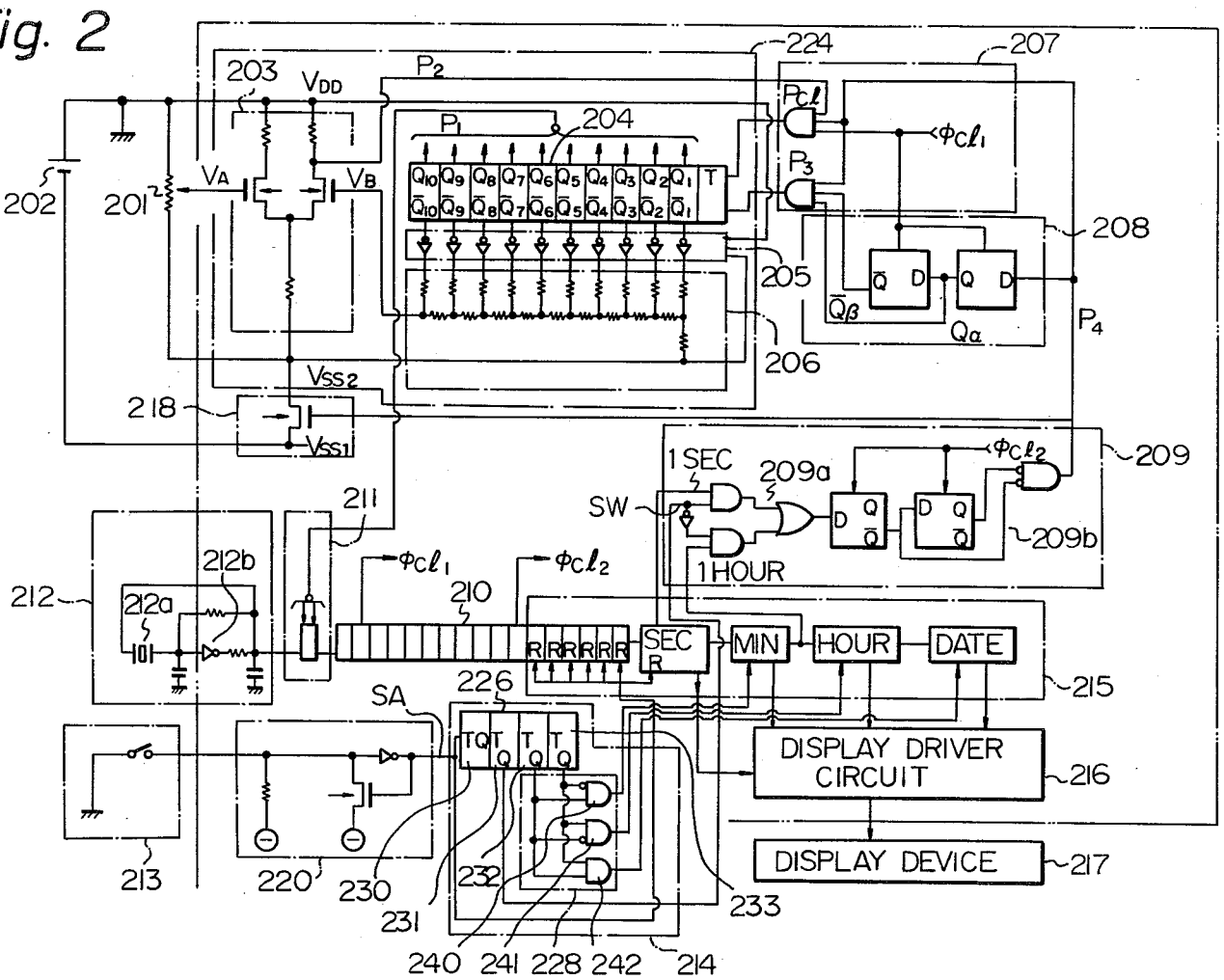
FIG. 2 is a detailed circuit diagram of the system block diagram shown in FIG. 1.
Figure 3:
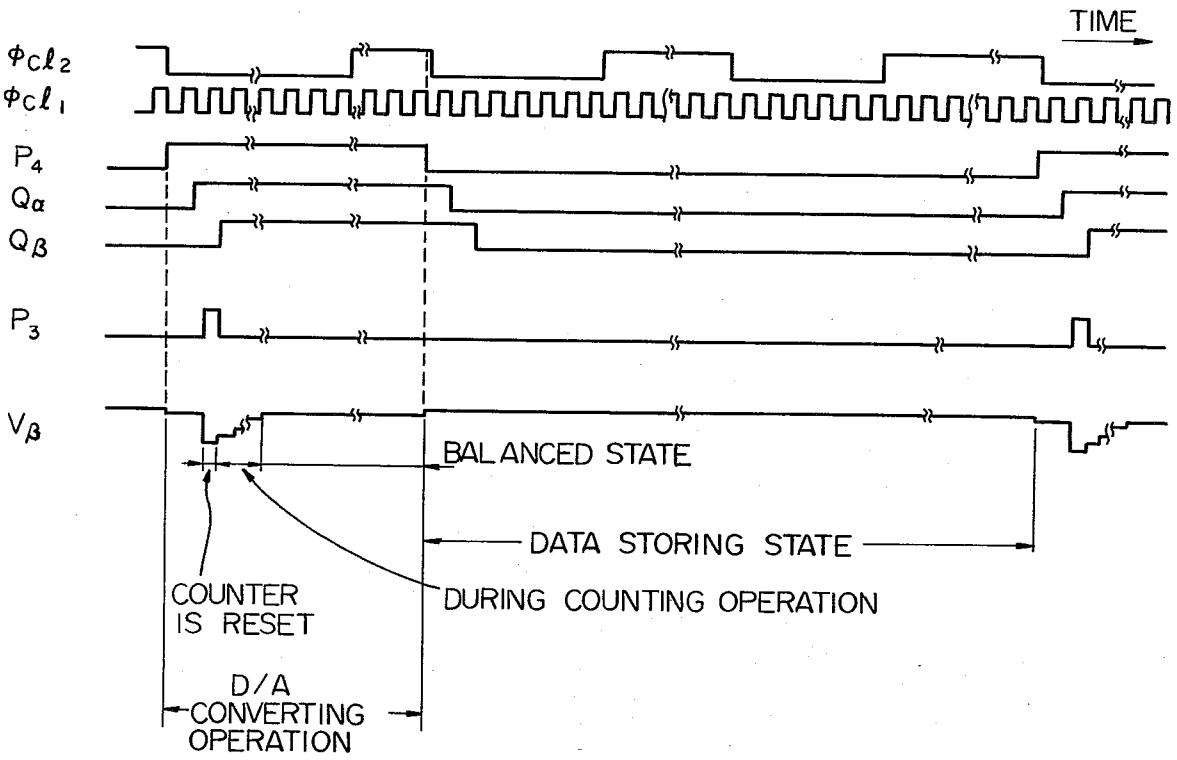
FIG. 3 is a time chart associated with FIG. 2.

FIG. 2 is a more concrete example of the block diagram depicted in FIG. 1, and FIG. 3 is the associated timing chart.

Referring to FIG. 2, reference numeral 201 denotes a variometer which serves as a potentiometer, 202 a battery which serves as a power supply, 203 a differential amplifier which serves as a comparator, 204 a digital counter as an A/D converter, 205 a buffer circuit for driving a D/A converter circuit, and 206 a ladder-type network which serves as a D/A converter. Reference numeral 207 designates a signal generation circuit which synthesizes a reset signal $P_3$ for A/D converter 224 and a clock signal $P_{Cl}$ for driving the digital counter 204. Designated at 208 is a differentiation circuit which generates a pulse synchronized with the rising portion of an input signal $P_4$ in order to produce the reset signal $P_3$, and designated at 209 is a circuit which generates sampling signals upon receipt of a 1 hour signal and a 1-second signal obtained from the timepiece circuit, and a SW signal obtained through operation of an external control member. In the present embodiment, circuit 209 includes a selection gate **209*a* and differentiation circuit 209*b*. An oscillator circuit 212 serves as a time base signal ganerator and is composed of, for example, a quartz crystal vibrator 212*a* and a C/MOS inverter circuit 212*b*. An operating state control means comprises a gain/loss adjustment circuit 211, which comprise an Ex-OR gate with a frequency adding capability, and a circuit which produces a compensation signal for the frequency adjustment. The compensation signal is controlled in response to the count in the digital counter 204. For a description of a known prior art method of controlling the compansation in response to the count in digital counter 104, please refer to FIG. 10 of British Pat. No. 145,007. Reference numeral 210 denotes a frequency divider which serves as a mechanism for producing a time unit signal, 215 a timekeeping circuit including a seconds counter, a minutes counter, a hours counter and a dates counter, 216 a display drive circuit, and 217 a time display device. An external control member 213 is used to correct, through an input circuit 220, time data in the timekeeping circuit. Designated at 214 is a control device responsive to the operation of control member 213 in order to correct the time. Control unit 214 is a control circuit including a counter circuit 226 composed of four toggle flip-flops 230–233, and a decoder circuit 228 for discriminating contents of the counter circuit 226. The counter circuit 226 is coupled to receive a signal SA which is produced by the action of the external control member 213. The decoder circuit 228 is composed of AND gate circuits 240, 241 and 242. The AND gate 240 has one input terminal connected to output terminal of TFF 232 and another input terminal connected to output terminal of TFF 233 through inverter. The AND gate 241 has one input terminal connected to output terminal of TFF 232 through the inverter and another input terminal connected to output terminal of TFF 233. The AND gate 242 has input terminals connected to output terminals of TFFs 232 and 233, respectively. When the signal SA is applied to the counter circuit 226, frequency divider 210 and seconds counter of the timekeeping circuit 215 are reset by the signal SA. Every two times the external control member 213 is actuated, a signal SW operating control circuit 224 is produced by the counter circuit 226. When the external control member 213 is actuated four times, a signal is applied to the minutes counter of the timekeeping circuit 215 from AND gate 240, whereby a rapid count of the minutes counter for correction is performed. When the external control member 213 is actuated eight times, a signal is applied to the hours counter of the timekeeping circuit 215 from AND gate 241, whereby a rapid count of the hours counter for correction is performed. When the external control member 213 is actuated sixteen times, a signal is applied to the dates counter from AND gate 242, whereby a rapid count of the dates counter for correction is performed. The signal SW is converted to the signal $P_4$ by means of circuit 209. Reference numeral 218 denotes a field effect transistor which serves as a switch circuit. Switch 218 corresponds to switch 105 of FIG. 1, and consists of an FET which is responsive to signal $P_4$ applied to gate terminal for enabling or inhibiting the supply of current from battery 202 to potentiometer 201, comparator 203 and digital-to-analog converter 206, to thereby enable or inhibit the operation of these circuit components. As is shown in FIG. 3, while signal $P_4$ is at the H level, the potentiometer 201, comparator 203 and digital-to-analog converter 206 are in operation, and counting by counter 204 of clock signal $P_{Cl}$ is performed (i.e. of signal Cl). After signal $P_4$ goes from the H level to the L level, operation of potentiometer 201, comparator 203 and digital-to-analog converter 206 is halted, and the digital signal which is output from counter 204 at the time when signal $P_4$ goes from the H level to the L level is held at that level and applied to gain/loss adjustment circuit 211**.

In FIG. 3, $\phi_{Cl2}$ is a clock signal synchronized with the falling edge of clock signal $\phi_{Cl1}$ and having a lower frequency. Signal $P_4$ is a pulse with a small duty ratio produced in circuit 209 in synchronism with the falling edge of $\phi_{Cl2}$. $Q_\alpha$ and $Q_\beta$ are signals which have latched $P_4$ and $Q_\alpha$ in synchronism with the falling edge of $\phi_{Cl1}$, and serves as reset signals the active phases (H level portions) of which occur slightly after the rising edge of $P_4$, these signals serving to reset the digital counter 204 which acts as the D/A converter. When $P_4$ is at an H level, the power supply is connected to potentiometer 201, differential amplifier 203 and the ladder type network 206 for a short time period. $P_{Cl}$ is counted until $V_A=V_B$, at which time differential amplifier 203 is balanced, whereby the count attains a specified value. The counted value in the counter is maintained when $P_4$ is at an L level. In a case where gain/loss adjustments are performed in a digital manner, any of the following methods may be employed: slightly changing the dividing ratio of a frequency divider; adjusting a separately provided compensation signal; switching over an oscillator circuit capacitor by means of a transmission gate; using electronic switching elements to switch over the amount of a phase shift in a phase advance or phase delay circuit installed in an oscillator circuit, or the value of the resistance or capacitance; or by changing, in an analog or digital manner, the biasing voltage of a variable capacitor installed in the LSI circuitry. In the embodiment of the present invention shown in FIG. 1 and FIG. 2, the digital output signal $P_1$ is shown as being continuously applied to gain/loss adjustment circuit 211, both during periods when counting is being performed by counter 204 and the much longer intervals during which the count in counter 204 is held at a steady-state value. The count in counter 204 will change during the intervals in which counting is performed, of course, i.e. during the interval from the reset of the counter 204 contents by signal $P_3$ to the generation of signal $P_2$ by comparator 203, which terminates counting by counter 204. However with the present invention, these intervals during which counting by counter 204 is performed are extremely short by comparison with the time periods during which the counter contents are held constant. For example, as describe hereinabove with respect to the embodiment of FIG. 1, the duty cycle of pulses $P_4$ can be made as low as 1/360,000, by causing pulses $P_4$ to have a duration of 10 milliseconds occurring once in every hour, for example. Thus, the effects of any transient changes in the contents of counter 204 occurring during these short $P_4$ pulse intervals will have a negligible effect upon the frequency of the signal which is output by gain/loss adjustment circuit 211. However, if it is desired to isolate the gain/loss adjustment circuit 211 from the effects of counting operations by counter 204, this can be performed by circuit means such as will be described hereinbelow with respect to the embodiment of FIG. 4, and indicated by reference numeral 404.

It should also be noted that it is possible to omit the periodic resetting of the contents of counter 204 by signal $P_3$. This is possible when, for example, adjustment of the timekeeping frequency is to be performed only at the time of assembly of the timepiece. The contents of counter 204 can be reset by some suitable method while such adjustment procedure is performed, and thereafter no further resetting performed. In this case, so long as the position of potentiometer 201 is not changed after such initial setting, the contents of counter 204 will remain at a constant value thereafter.

The present invention makes it possible to supply a large amount of information to an integrated circuit equipped with a small number of terminals. Although an example of a gain/loss adjustment was described above, it is also possible to control the color or intensity of a liquid crystal display by modulating the voltage, pulse width or waveform of a signal applied to a liquid crystal display element. In other words, the state of a liquid crystal display can be changed by transmitting the output signal $P_1$ from counter 103 to the liquid crystal drive control section of the timepiece circuit 104 in FIG. 1.

Figure 4:
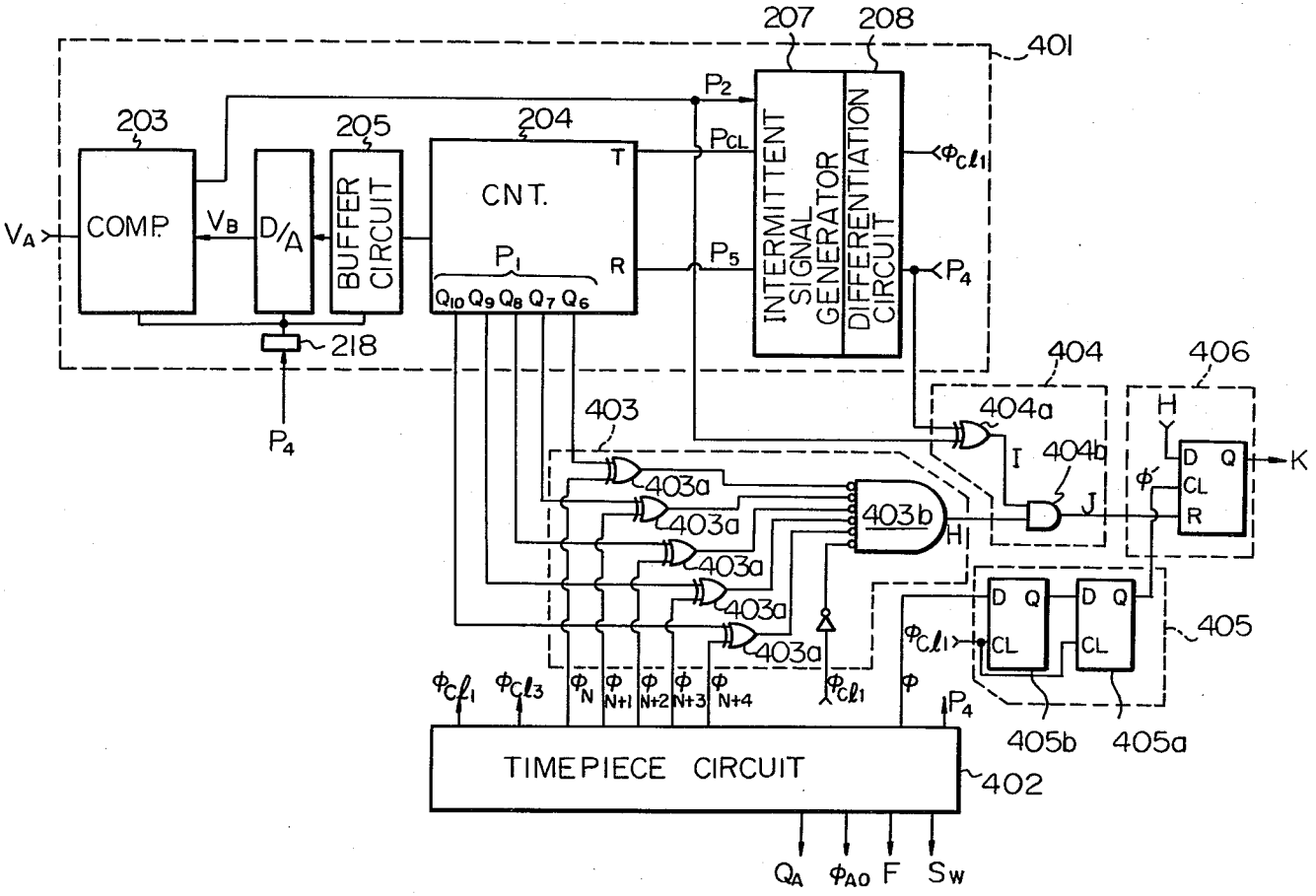
FIG. 4 is an embodiment of a signal forming circuit adapted to produce signals modulated in pulse width by a digital signal according to the present invention.
Figure 5:
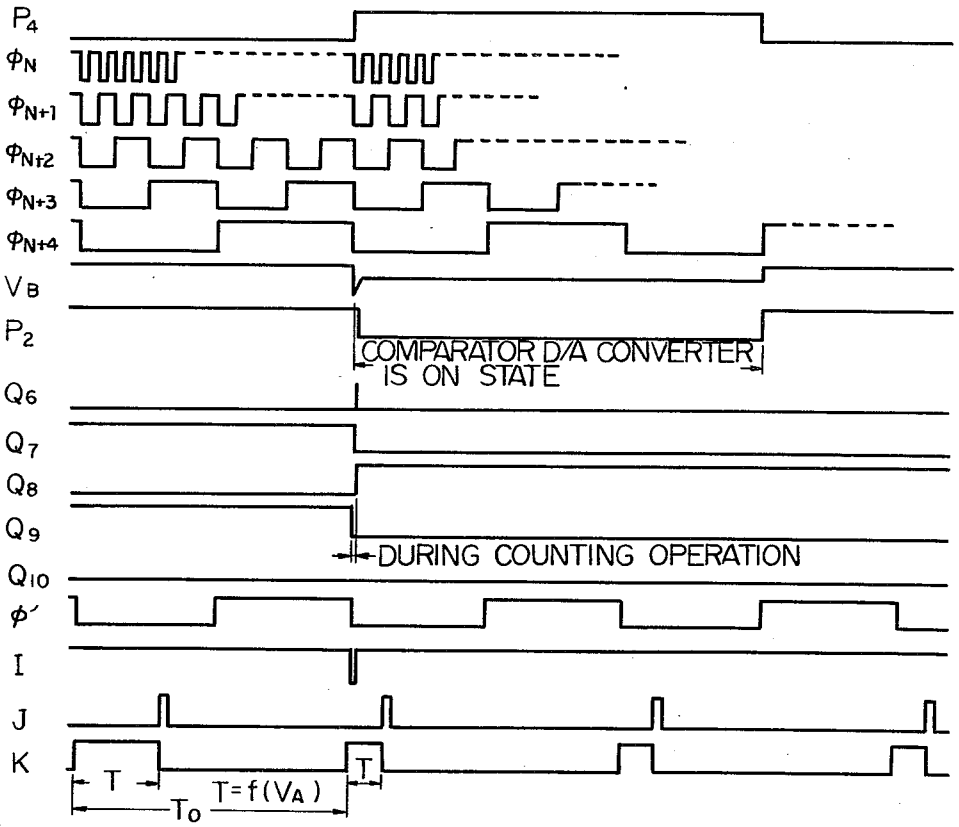
FIG. 5 is a time chart associated with FIG. 4.

FIG. 4 illustrates another preferred embodiment of an electronic timepiece including a liquid crystal display modulation circuit. In FIG. 4, a control circuit 401 similar to the one of FIG. 2 is composed of a comparator 203, digital counter 204 to generate a plurality of output signals serving as a control signal $P_1$, buffer circuit 205, D/A converter 206, switching element 218, signal generation circuit 207 and differentiation circuit 208, and is adapted to convert an analog input signal $V_A$ into digital output signals $Q_6$, $Q_7$, $Q_8$, $Q_9$ and $Q_{10}$. The time chart for control circuit 401 has already been described with reference to FIG. 3. A timepiece circuit 402 is composed of an oscillator circuit, frequency divider circuit, drive circuit and wave shaping circuit. $\phi_{Cl1}$, $\phi_{Cl3}$, $\phi_N$, $\phi_{N+1}$, $\phi_{N+2}$, $\phi_{N+3}$, $\phi_{N+4}$, $\phi$ and $P_4$ are a variety of clock pulses formed in timepiece circuit 402, and possess frequencies of the following order:

$$\phi_{Cl1}>\phi_{Cl3}>\phi_N>\phi_{N+1}>\phi_{N+2}>\phi_{N+4}\geqq\phi,$$

with $P_4$ being the differentiation signal $P_4$ of FIG. 2. A coincidence detection circuit 403 is composed of exclusive-OR gate **403*a* and NOR gate 403*b* and is adapted to produce an output signal H when the signal delivered from control circuit 401 and the clock pulses from timepiece circuit 402 are found to be coincident upon being compared. An inhibiting circuit 404 is composed of an exclusive-OR gate 404*a* and an AND gate 404*b* and is adapted to inhibit the transmission of the signal H over an interval which begins with the resetting of the counted value in the counter of control circuit 401 and which ends when the counted value has attained a value corresponding to the analog signal $V_A$. Inhibiting circuit 404 is thus adapted to produce an output signal J which is the signal H from which noise pulses, which are present while the counter is counting, are removed. A delay circuit 405 is composed of data-type trigger flip-flops 405***a*, 405*b* and is reset upon bringing clock pulse $\phi$ into synchronism with the falling portion of clock pulse $\phi_{Cl1}$, thereby producing an output signal $\phi'$. A data-type trigger flip-flop 406 is set in synchronism with the falling portion of clock pulse $\phi'$ and is reset by output signal J from inhibiting circuit 404, and is adapted to produce a signal K the width of which is modulated by signal J. Thus, the circuit of FIG. 4 serves as a pulse width modulation circuit adapted first to convert analog signal $V_A$ to digital signals $Q_6$ through $Q_{10}$ by using control circuit 401, thereby to produce the output signal K the pulse width of which is modulated in conformance with digital signals $Q_6$ through $Q_{10}$ and which has a period equal to that of clock pulse $\phi$. It should be noted, however, that the frequency of signal K may vary depending upon the particular application. In addition, control circuit 401 is capable of operating intermittently as in the case of the converter of FIG. 2. It is also permissible to transmit the counter output signals $Q_6$ through $Q_{10}$ from control circuit 401 to a latch circuit, and then couple the latch circuit output signals to coincidence detection circuit 403. The time-chart illustrative of the operation of the above circuitry is depicted in FIG. 5.

The embodiment shown in FIG. 4 and describe above incorporates an inhibition circuit 404, for inhibiting the utilization of the digital output signal from counter 204 (which controls the output signal from gate 403*b*) by circuitry which is controlled by signal K; while counting by counter 204 is being performed. It should be understood that, depending upon the particular application for which signal K is used, it may be possible to omit the inhibition circuit 404, as is done in the case of the first embodiment of the present invention shown in FIG. 1 and FIG. 2 above. Thus, while various embodiments of circuit controlled by signal K are described hereinafter, it should be understood that in each case, it is equal possible to utilize a circuit for producing signal K which incorporates an inhibition circuit such as that of FIG. 4 or to utilize a circuit for producing signal K which does not incorporate an inhbition circuit such as circuit 404. If any slight change in the pulse width of signal K caused by a count operation of circuit 204 can be neglected, then it is possible to omit an inhibition circuit such as circuit 404 of FIG. 4.

Figure 6:
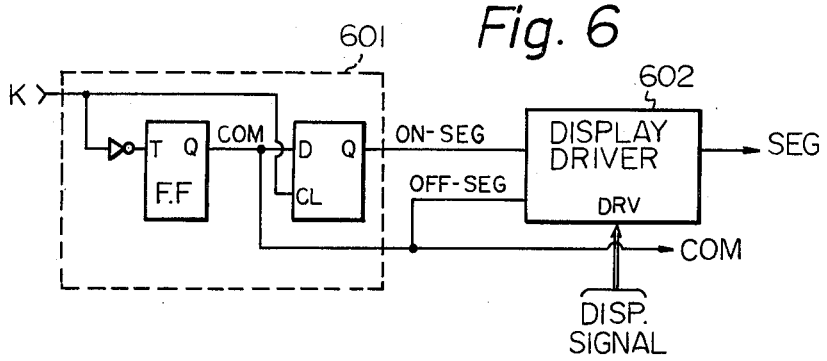
FIG. 6 is a liquid crystal display drive circuit based on pulse modulation.
Figure 7:
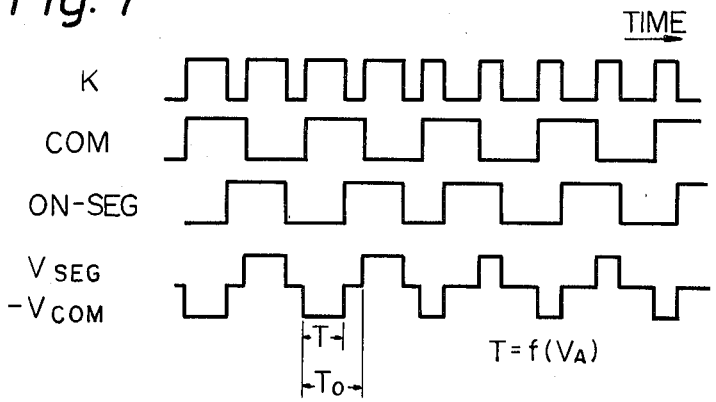
FIG. 7 is a time chart associated with FIG. 6.

FIG. 6 shows a liquid crystal display circuit serving as an operating state controlling means adapted to be driven by the output signal K generated by the circuit shown in FIG. 4. A delay circuit 601 produces a frequency divided signal COM having one-half the frequency of signal K, and a frequency divided signal ON-SEG delayed with respect to signal COM by an amount equal to the pulse width of signal K. Reference numeral 602 denotes a display drive circuit for driving a liquid crystal display. Thus, with the liquid crystal display in the ON state, a voltage is applied to the electrodes of the display device for a period of time equal to the pulse width of the signal K. The circuits illustrated in FIGS. 4 and 6 are therefore adapted to apply voltage to the electrodes of the liquid crystal display device for a period of time which corresponds to the analog signal $V_A$, so that the display is modulated by the analog signal $V_A$. The associated timing chart is shown in FIG. 7.

The present invention can also be applied to an alarm watch to achieve pulse width control for modulating the loudness, length or tone quality of an alarm, to regulate loudness by controlling voltage, or to regulate the alarm by controlling the frequency. Examples of such applications are shown in the forms of simple embodiments as illustrated in FIGS. 8, 9, 11 and 13.

Figure 8:
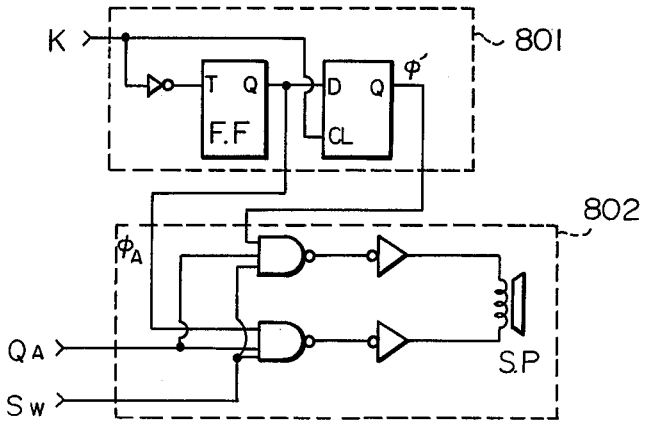
FIG. 8 is an alarm control circuit.

FIG. 8 shows an alarm loudness control circuit in serving as an operating state controlling means, reference numeral 801 designating a delay circuit which operates in the same fashion as delay circuit 601 of FIG. 6, while reference numeral 802 denotes an alarm drive circuit. A signal $Q_A$ spacifies the length of the alarm tone and has, for example, a period of 1 second and a pulse width of $\frac{1}{2}$ second, while a signal SW is a signal which switches the alarm ON and OFF. Thus, through an operation identical to that described with reference to FIG. 6, signal K controls the pulse width of the voltage applied to an alarm device SP.

Figure 9:
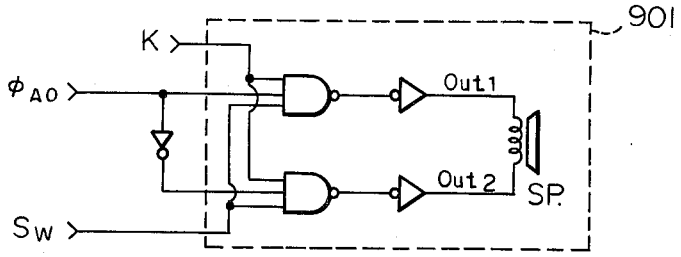
FIG. 9 is a circuit for controlling the length fo an alarm tone.
Figure 10:
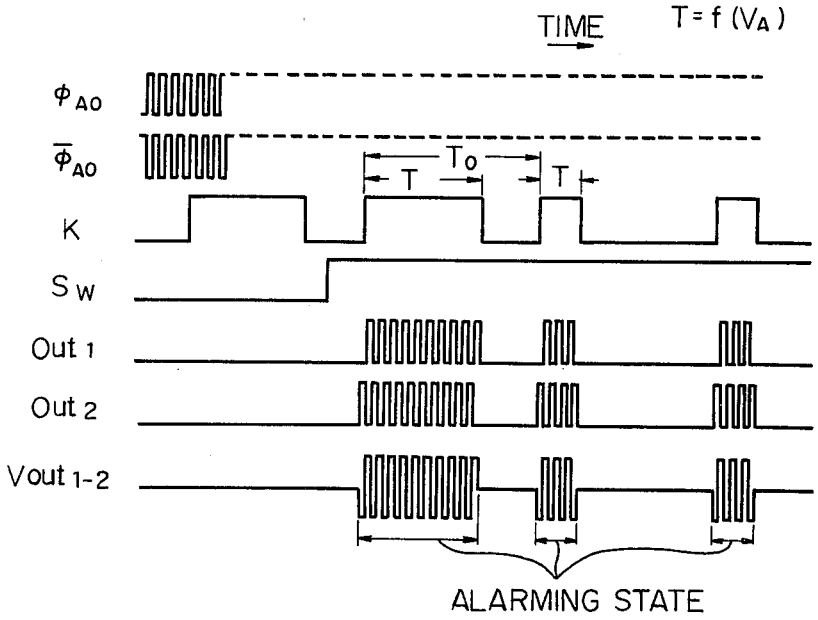
FIG. 10 is a time chart associated with FIG. 9.

FIG. 9 shows a circuit for controlling the length of an alarm tone. An alarm drive circuit 901 operates in the same manner as the drive circuit 802 of FIG. 8, but the circuit in this case is connected to signal K instead of signal $Q_A$. $\phi_{Ao}$ is a pulsed signal for oscillating the alarm device. The circuit operates such that signal K adjusts the length of the alarm tone during one alarm period. The associated time chart is shown in FIG. 10.

Figure 11:
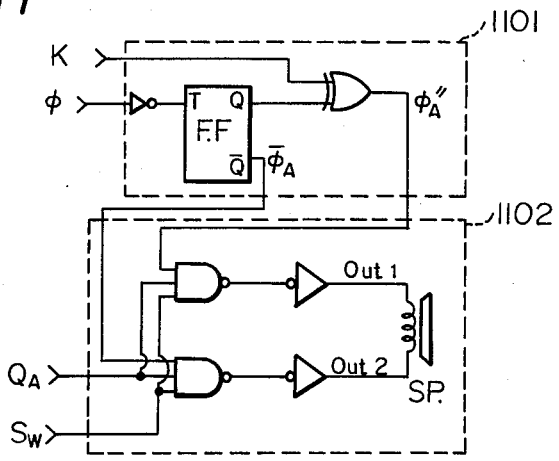
FIG. 11 is a circuit for controlling the tone quality of an alarm.
Figure 12:
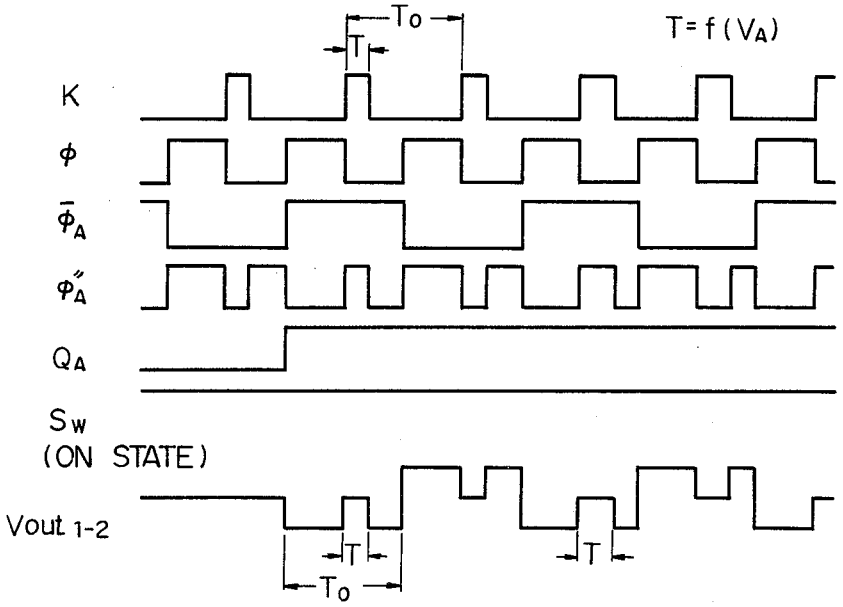
FIG. 12 is a time chart associated with FIG. 11.

FIG. 11 shows a circuit for controlling the tone quality of an alarm. The circuit is adapted to adjust the tone quality of the alarm by allowing signal K to shape the waveform of the pulsed signal $\phi_{Ao}$ which activates the alarm device as in FIG. 9. To this end, the circuit is equipped with a waveform shaping circuit 1101 and a circuit 1102 that operates in the same manner as the drive circuit 802 of FIG. 8. The associated time chart is shown in FIG. 12.

Figure 13:
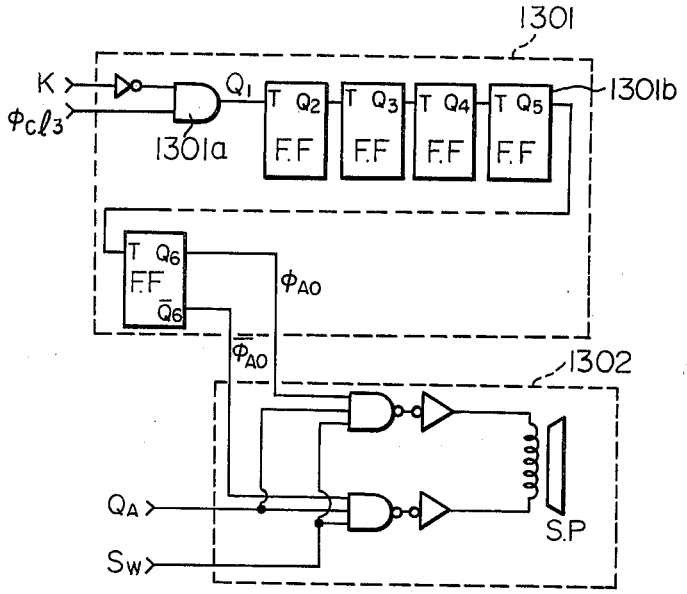
FIG. 13 is an alarm tone frequency control circuit.
Figure 14:
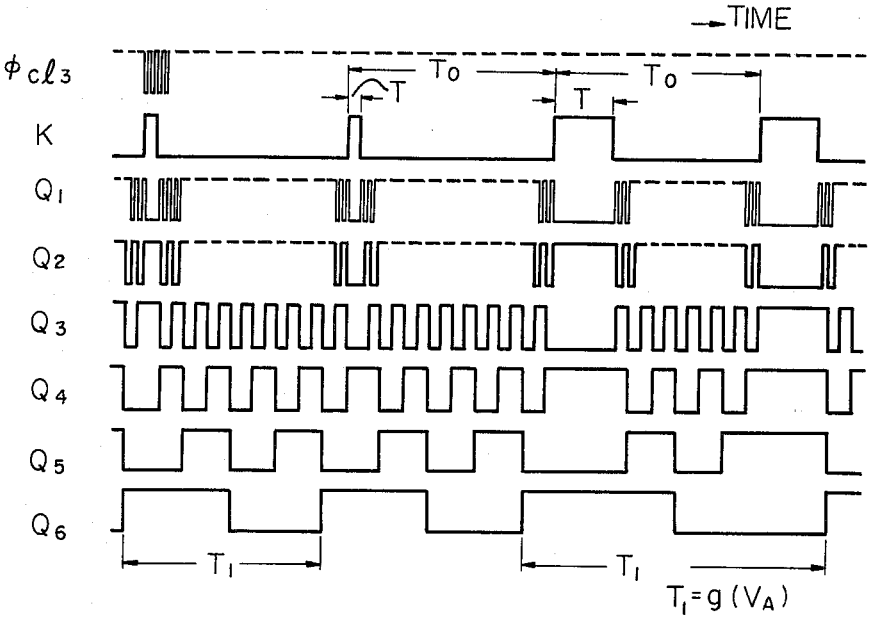
FIG. 14 is a time chart associated with FIG. 13.

FIG. 13 illustrates a frequency control circuit for controlling the frequency of the alarm tone. A frequency modulation circuit 1301 is composed of an AND gate 1301*a* and frequency divider 1301*b* and is adapted to vary the frequency of output signal $\phi_{Ao}$ in accordance with the pulse width of signal K. An alarm drive circuit is designated at 1302. The time chart associated with frequency modulation circuit 1301 is shown in FIG. 14. Ultimately, in all of these examples, the function of the alarm is controlled by analog signal $V_A$.

Figure 15:
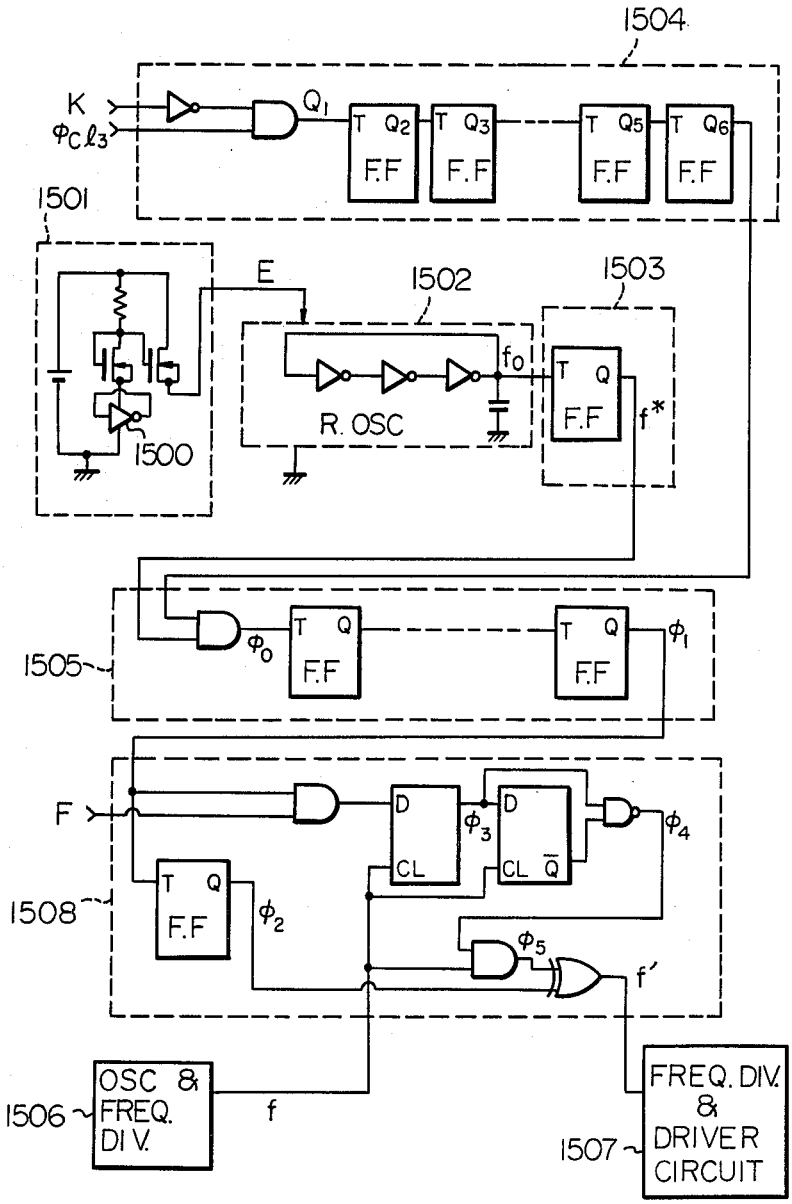
FIG. 15 is a temperature compensation circuit for frequency adjustment.
Figure 16:
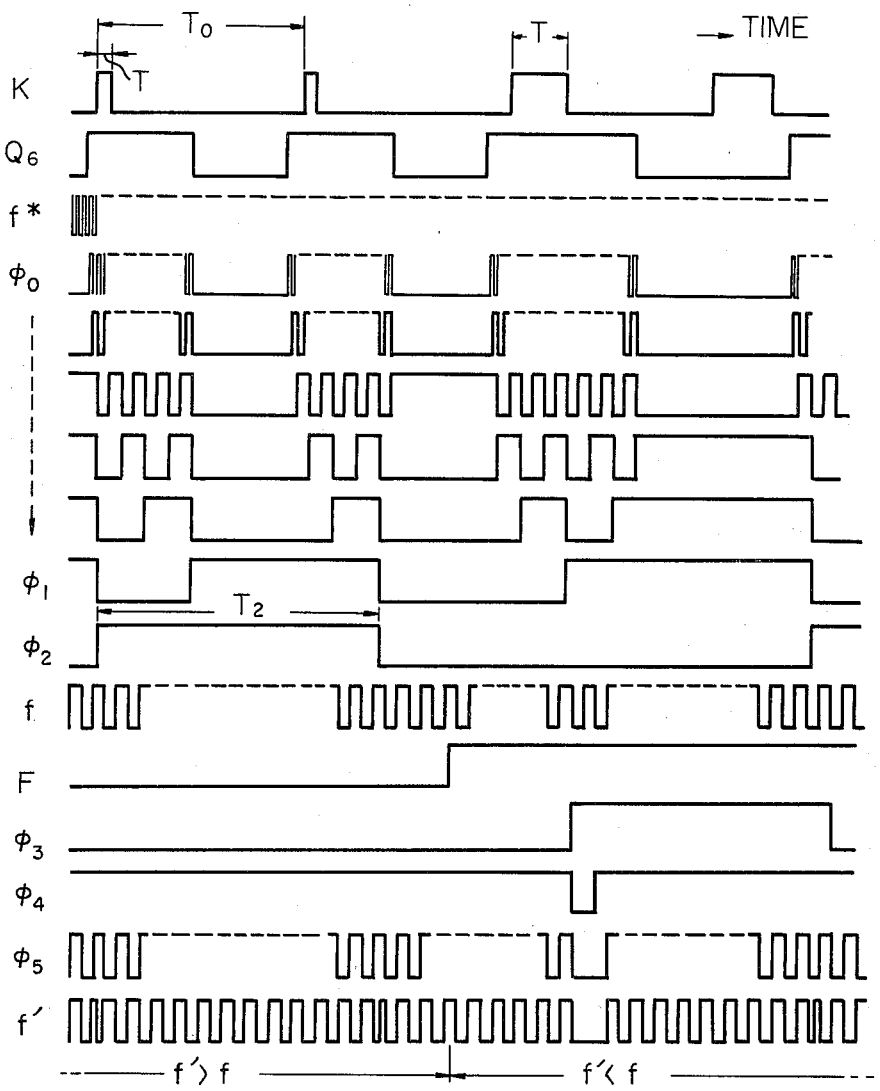
FIG. 16 is a time chart associated with FIG. 15.

The present invention can also be applied in an electronic timepiece having a temperature compensation capability and can be adapted to set such characteristics as the temperature coefficient of a temperature sensitive element or the reference temperature. One example of such an application is embodied in the drawing of FIG. 15. A constant voltage circuit 1501 is composed of MOSFETs and its output voltage is decided by the threshold voltage of each transistor of an inverter 1500. The circuit is designed such that its output voltage E is affected by the temperature only and not, for the most part, by the battery voltage. A ring oscillator 1502 comprising a plurality of inverters has its oscillating frequency $f_o$ influenced by the supply voltage E and the temperature. Accordingly, the oscillating frequency $f_o$ is varied only by temperature owing to the combination of the constant voltage circuit 1501 and ring oscillator circuit 1502. A frequency divider 1503 produces an output signal f* upon receiving the output signal from ring oscillator 1502. Frequency modulation circuits 1504, 1505 which produce the respective outputs $Q_6$ and $\phi_1$ operate in the same manner as frequency modulation circuit 1301 of FIG. 13. Reference numeral 1506 denotes a portion of the conventional timepiece circuit comprising oscillator and frequency divider circuits adapted to produce an output signal f. Reference numeral 1507 also denotes a portion of a conventional timepiece circuit comprising frequency divider and driver circuits. When the output f of the frequency and divider circuitry 1506 is directly connected to the frequency divider and drive circuitry 1507, the timepiece circuit functions without undergoing a temperature compensation. A frequency addition-subtraction circuit 1508 is adapted to control the frequency of output signal f from the frequency and divider circuitry 1506 in accordance with the pulse width of output signal $\phi_1$ from frequency modulation circuit 1505. The output of circuit 1508 is a signal f'. F denotes an ADD-SUBTRACT control signal applied to addition-subtraction circuit 1508 which performs a subtraction operation when the signal F is at an H level, and an addition operation when the signal is at an L level. Accordingly, when the frequency of output signal $Q_6$ from frequency modulation circuit 1504 is constant, that is, when the pulse width of signal K is constant, the output signal f from frequency and divider circuitry 1506 undergoes a given temperature compensation for adjustment of frequency. However, varying the pulse width of signal K allows the temperature compensation operation to be controlled. In other words, the analog signal $V_A$ allows for adjustment of the temperature origin of the circuitry which compensates the frequency for variations in temperature. The time chart for the circuit of FIG. 15 is shown in FIG. 16. It should also be noted that the temperature coefficient can be adjusted if the frequency dividing ratio of circuit 1505 is adjusted in a similar manner.

It is obvious from the foregoing description that the conversion of an analog signal to a digital signal allows the functioning of an electronic timepiece to be freely controlled despite a small number of terminals. Moreover, the addition of a logic switching circuit makes it possible to set a large number of functions by means of a single analog input signal. Accordingly, the utilization of a multi-level input system that employs the control circuit of the present invention is extremely practical since the number of terminals for an IC can be reduced.

What is claimed is:

1. An electronic timepiece comprising:

a timepiece circuit including means for generating clock pulses and means for controlling the operational state of the timepiece; and a control circuit connected to the timepiece circuit for controlling said operational state and including a counter responsive to said clock pulses to provide a digital output signal, a digital/analog converter converting said digital output signal into an analog output signal, a potentiometer adapted to provide an analog input signal, a comparator for comparing said analog output signal and said analog input signal and producing an output signal when said analog output signal and said analog input signal coincide with one another, said control circuit being responsive to said output signal from said comparator to stop the operation thereof whereafter said digital output signal is applied to said operational controlling means as a control signal by which the operational state of said timepiece circuit is controlled and said control circuit further includes switching means for controlling the operation of each of said potentiometer, said digital-/analog converter and said comparator;

wherein said control signal comprises a plurality of digital output signals, and said timepiece circuit generates a plurality of clock signals;

a pulse width modulation circuit including coincidence detection circuit for detecting a coincidence between said plurality of digital output signals and said plurality of clock signals to generate a coincidence signal; and means for generating a pulse width modulated signal in response to said coincidence signal.

2. An electronic timepiece according to claim 1, in which said timepiece circuit further includes means for generating intermittent signal by which said counter is intermittently activated.

3. An electronic timepiece according to claim 1, further comprising means for inhibiting the supply of said coincidence signal to said pulse width modulated signal generating means in response to the output signal from said comparator.

4. An electronic timepiece according to claims 1 or 3, in which said timepiece circuit also includes a liquid crystal display device, and said operating state controlling means comprises a display driver circuit responsive to said pulse width modulated signal to drive said liquid crystal display device so as to apply a driving voltage signal thereto for a time interval determined by said pulse width modulated signal.

5. An electronic timepiece according to claims 1 or 3, in which said timepiece circuit includes an alarm device, and said operating state controlling means comprises an alarm driver circuit for driving said alarm device.

6. An electronic timepiece according to claim 5, in which said alarm driver circuit includes means responsive to said pulse width modulated signal to vary the loudness of alarm tone generated by said alarm device in dependence on said pulse width modulated signal.

7. An electronic timepiece according to claim 5, in which said alarm driver circuit includes means responsive to said pulse width modulated signal for varying the length of alarm tone generated by said alarm device.

8. An electronic timepiece according to claim 5, in which said alarm driver includes means responsive to said pulse width modulated signal for varying the tone quality of alarm generated by said alarm device.

9. An electronic timepiece according to claim 5, in which said alarm driver circuit includes means responsive to said pulse width modulated signal for varying the frequency of alarm tone generated by said alarm device.

10. An electronic timepiece according to claim 1 or 3, in which said timepiece circuit includes an oscillator circuit providing an output frequency signal, and said operating state controlling means comprises temperature compensation circuit means for controlling said output frequency signal in dependence on ambient temperature, said temperature compensation circuit means being controlled in response to said pulse width modulated signal to allow a temperature compensation operation to be controlled by said temperature compensation circuit means.

* * * * *